United States Patent [19]

Townsend

[11] Patent Number: 4,620,833

[45] Date of Patent: Nov. 4, 1986

[54] FAN ROTOR

[76] Inventor: Darold I. Townsend, 730 Cherry St., Cherokee, Iowa 51012

[21] Appl. No.: 681,884

[22] Filed: Dec. 14, 1984

[51] Int. Cl.[4] ..... F04D 29/28; F04D 29/44

[52] U.S. Cl. ..... 415/211; 415/213 R; 416/197 R; 416/237

[58] Field of Search ..... 415/206, 213 R, 211, 415/97; 416/184, 197 R, 235, 237, 211, 210 R, 222, 223 B

[56] References Cited

U.S. PATENT DOCUMENTS

| | | | |
|---|---|---|---|
| 126,639 | 5/1872 | Leffel | 415/206 X |
| 195,865 | 10/1877 | Wilson | 416/237 X |
| 223,300 | 1/1880 | Smethells | 415/213 R X |
| 304,028 | 11/1905 | Neumann | 415/213 R X |
| 1,671,373 | 5/1928 | Martin | 416/197 R X |

FOREIGN PATENT DOCUMENTS

| | | | |
|---|---|---|---|
| 25771 | 11/1925 | United Kingdom | 415/213 R |
| 583729 | 12/1946 | United Kingdom | 415/206 |

*Primary Examiner*—Robert E. Garrett

*Assistant Examiner*—Joseph M. Pitko

*Attorney, Agent, or Firm*—Zarley, McKee, Thomte, Voorhees & Sease

[57] ABSTRACT

A fan rotor comprises a housing defining an interior air chamber and includes air inlet openings and an air outlet opening. A rotor blade is rotatably mounted within the chamber and includes a polygonal rotor plate disposed in parallel relation to the sidewalls of the housing and a plurality of channel-shaped blade members secured in perpendicular relation to the perimeter of the rotor plate. The rotor assembly is mounted upon a drive shaft which is rotatably connected to a power source. During rotation of the rotor assembly, air is drawn into the chamber through the inlet openings at a first velocity and is expelled through the outlet opening at a second increased velocity. The increased pressure upon the blade members helps to hold the blades in place upon the perimeter of the rotor plate. A plurality of arcuate air deflection shields extend between the side walls of the housing so as to form a cylindrical cage within the chamber for directing the flow of the air therein.

2 Claims, 5 Drawing Figures

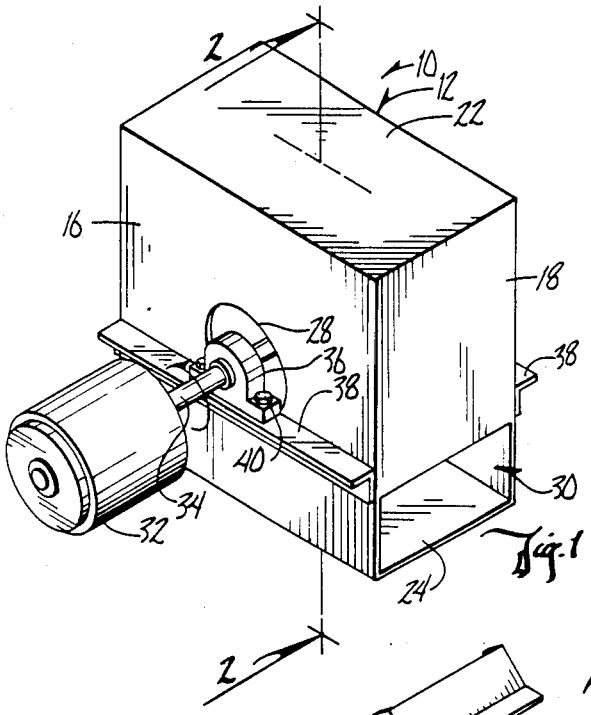
Fig. 1
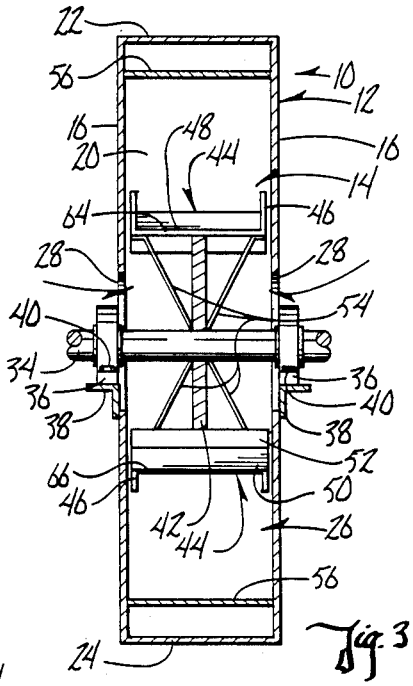
Fig. 3
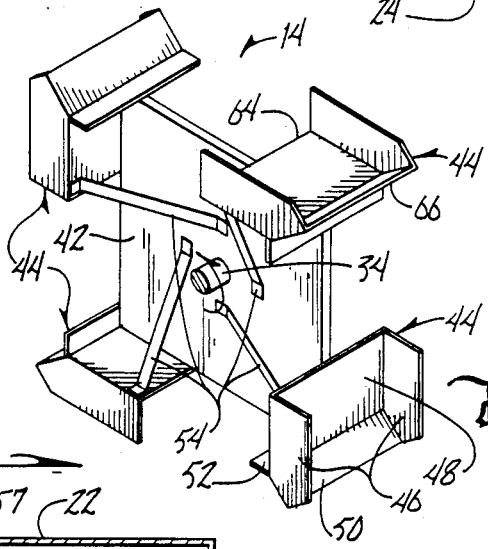
Fig. 4
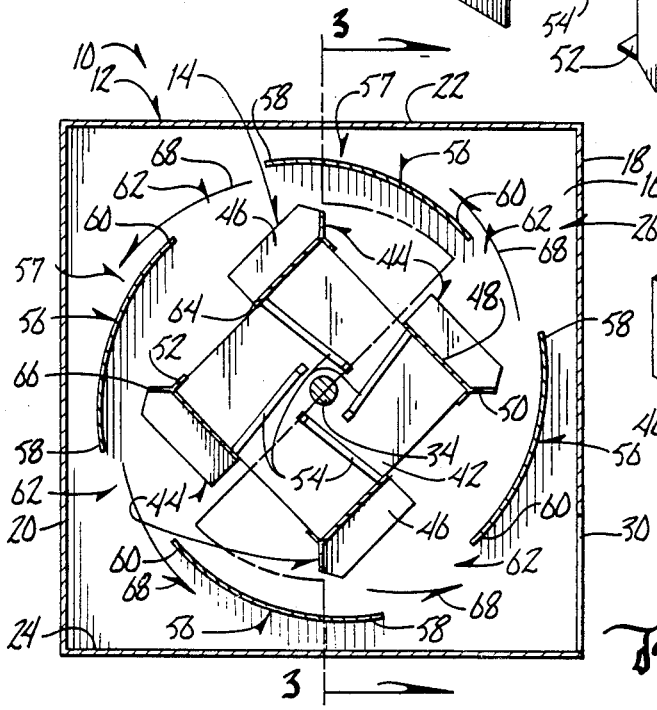
Fig. 2.
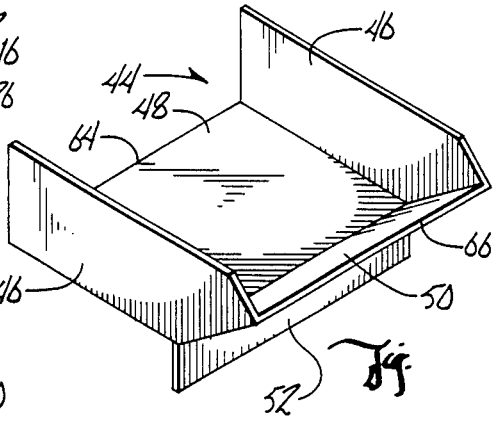
Fig.

FAN ROTOR

BACKGROUND OF THE INVENTION

This invention relates to a fan rotor and particularly to an enclosed chamber fan for producing high velocity directionalized air flow.

Conventional compartmentalized fans typically are complex in structure and include many blades and baffles and multiple chambers for creating high velocity air flow. Such fans also require particularly strong connections between the fan blades and the rotating shaft or plate due to the centrifugal force developed during rotation of the blades. Such construction resulted in costly heavy fans.

Therefore, it is a principal objective of the present invention to provide a fan rotor which has a minimun number of blades and baffles for producing high velocity directionalized air flow.

A further objective of the present invention is the provision of a fan rotor in which the rotor blades are held in place on the rotor plate by the air pressure exerted on the upper surface of the rotating blades and the vacuum created on the undersurface of the rotating blades.

Still another objective of the present invention is the provision of a fan rotor which is operational at high revolutions per minute.

A further objective of the present invention is the provision of a fan rotor which is economical to manufacture, simple in construction, durable in use, and efficient in power consumption.

SUMMARY OF THE INVENTION

The fan rotor of the present invention includes an enclosed housing forming an interior chamber in which the rotating components of the fan rotor are enclosed. The housing includes air inlet openings in each of the parallel side walls and an air outlet opening in one of the end walls of the housing. A rotor blade means is rotatably mounted within the chamber defined by the housing.

The rotor blade means includes a central polygonal rotor plate disposed in parallel relation to the housing side walls and a plurality of blade members secured in perpendicular relation to the perimeter of the rotor plate. Each blade member has opposite side walls disposed in parallel relation to the housing side walls and in close proximity thereto, and a pair of angularly disposed panels extending between the opposite side walls such that the blade member is channelshaped. The rotor plate is mounted at its center point upon an elongated rotatable drive shaft extending from a motor such that the actuation of the motor rotates the shaft, the rotor plate, and the connected blade members. The pitch of the blade members with respect to the arc of rotation produces increased air pressure upon the upper surface of the blades so as to force the blade members into secure engagment with the rotor plate. The blade members are further held in place by the vacuum which is created on the underneath side thereof as air is drawn through the air inlet openings at one velocity and forced out the air outlet opening at an increased velocity during operation of the fan rotor.

The fan rotor also includes a plurality of arcuate air deflection shields extending between the housing side walls in perpendicular relation thereto so as to form a cylindrical cage within the chamber. The deflection shields are positioned close to the blade members and are circumferentially spaced apart with the forward edge of the shield being radially spaced further from the axis of rotation of the rotor blade means than the rearward edge of the shield. The air within the chamber is thus moved by the rotating blade members in a substantially circular path defined by the deflection shields and is forced through the spaces between adjacent shields and out the air outlet opening at a high directionalized velocity.

BRIEF DESCRIPTION OF THE DRAWINGS

FIG. 1 is a perspective view of the fan rotor of the present invention.

FIG. 2 is a sectional side elevation view taken along lines 2—2 of FIG. 1.

FIG. 3 is a sectional end view taken along lines 3—3 of FIG. 2.

FIG. 4 is a perspective view of the rotor means of the present invention.

FIG. 5 is a perspective view of a blade member of the rotor means.

DESCRIPTION OF THE PREFERRED EMBODIMENT

The numeral 10 generally designates the fan of the present invention as shown in FIG. 1. Fan 10 is basically comprised of a housing assembly 12 and a rotor means 14 shown in FIG. 4.

Housing assembly 12 comprises opposite parallel side walls 16, front wall 18, back wall 20, top wall 22 and bottom wall 24 which define an interior chamber 26. Each side wall 16 includes an air inlet opening 28 and front wall 18 includes an air outlet opening 30.

A motor 32 has an elongated rotatable drive shaft 34 extending therefrom. Drive shaft 34 extends through housing assembly 12 and is journaled within a pair of roller bearings 36 adjacent each side wall 16. Each roller bearing 36 is attached to the respective side wall 16 in any convenient manner, such as by angle iron 38 and bolts 40. The longitudinal axis of drive shaft 34 is perpendicular to side walls 16.

Rotor means 14 comprises a rotor plate 42 and a plurality of blade members 44 mounted to the perimeter of rotor plate 42. In the drawings, rotor plate 42 is shown to be square for ease of construction; however, plate 42 may be of any symmetrical shape. Plate 42 is rigidly mounted upon drive shaft 34 such that rotation of shaft 34 rotates plate 42 and blade members 44.

Each blade member 44 has a channel-like construction and includes a pair of opposite side walls 46, a first panel 48, a second panel 50, and a third panel 52. Side walls 46 of blade member 44 are disposed in a parallel relation to the side walls 16 of housing 12 and are in close proximity thereto, as seen in FIG. 3. First panel 48 extends between side walls 46 and is secured in perpendicular relation to the perimeter of rotor plate 42 in any convenient manner, such as by strap elements 54. Second panel 50 also extends between opposite side walls 46 and is angularly disposed with respect to first panel 48. Third panel 52 extends along the underneath side of blade member 44 to provide structural stability thereto.

Fan 10 also includes a plurality of arcuate air deflection shields 56 extending between side walls 16 of housing 12 and being rigidly mounted in perpendicular relation thereto so as to form a cylindrical cage 57 within chamber 26. Each deflection shield 56 has a forward edge 58 and a rearward edge 60. Forward edge 58 is radially spaced further from the longitudinal axis of drive shaft 34 than rearward edge 60. Also, forward edge 58 of one deflection shield 56 is circumferentially spaced apart from the rearward edge 60 of the next adjacent shield such that a gap 62 between adjacent shields is present.

In operation, motor 32 rotates drive shaft 34 and therefore rotor plate 42 and blade members 44 in a counterclockwise direction. Blades 44 thus have a leading edge 64 and a trailing edge 66. The rotation of rotor means 14 causes air to be drawn through inlet openings 28 into chamber 26. The air within chamber 26 is pushed by first and second panels 48 and 50 of blade members 44 to the perimeter of cage 57 wherein the air follows a generally circular path along arcuate shields 56. As the angular velocity of the air within chamber 26 increases to that of rotating rotor means 14, the air pressure upon first and second panels 48 and 50, respectively, forces blade members 44 into secure engagement with the perimeter of rotor plate 42. Furthermore, the air entering chamber 26 through inlet openings 28 is at a lower velocity than the air circling about the perimeter of cage 57 such that a vacuum is created on the underneath side of blade members 44 so as to further hold blade members 44 in place upon rotor plate 42. A portion of the air moving along arcuate shields 56 passes through gaps 62, as indicated by arrows 68 in FIG. 2, and eventually out outlet opening 30.

Thus, fan 10 of the present invention produces high velocity directionalized air flow, and it can be seen that the device accomplishes at least all of its stated objectives.

What is claimed is:

1. A fan rotor assembly comprising:

a housing having opposite side walls and a perimeter wall interconnecting said side walls so as to define an internal chamber, and having an air inlet opening in at least one of said side walls, and an air outlet opening in said perimeter wall;

an elongated rotatable drive shaft extending between said side walls of said housing and having a longitudinal axis disposed perpendicularly to said side walls;

a polygonally shaped rotor plate secured to said drive shaft for rotation therewith and being disposed in parallel relation to said side walls of said housing and having a perimeter edge;

a plurality of blade members secured to said rotor plate for rotation therewith, each of said blade members including a flat first panel having opposite forward and rearward edges and extending along the perimeter edge of said rotor plate in perpendicular relation thereto with said forward edge being closer to said drive shaft than said rearward edge and a second panel having a forward edge attached to the rearward edge of said first panel and a rearward edge spaced radially outwardly from said rearward edge of said first panel such that said first panel and said second panel form a substantially concave surface from the forward edge of said first panel to the rearward edge of said second panel, said concave surface being presented radially outwardly;

each of said blade members further including opposite side wings disposed in parallel relation to said side walls of said housing, and power means for rotating said drive shaft, and thereby said rotor plate and said blade members, whereby air is drawn through said inlet opening into said internal chamber at a first velocity and pushed through a substantially circular path by said concave surface of said blade member so as to be expelled through said outlet opening at a second increased velocity and such that rotation of said rotor plate and blade members produces increased pressure on said concave surface of said blades and decreased pressure radially inwardly from said concave surface thereby forcing said blades into secure engagement with said perimeter edge of said rotor plate.

2. The fan rotor assembly of claim 1 further comprising a plurality of arcuate air deflection shields extending between said first and second walls and rigidly mounted in perpendicular relation thereto so as to form a cylindrical cage within said chamber, said deflection shields each having a forward edge and a rearward edge and the forward edge of each of said deflection shields being radially spaced further from the axis of rotation of said rotor blade means than said rearward edge of the respective deflection shield, said forward edge of one shield being circumferentially spaced apart from the rearward edge of the next adjacent shield.

* * * * *